US009890610B2

(12) United States Patent
Jordan

(10) Patent No.: US 9,890,610 B2
(45) Date of Patent: Feb. 13, 2018

(54) MECHANICAL METHOD FOR RESTORING DOWNHOLE CIRCULATION

(71) Applicant: Advanced Frac Systems LP, Houston, TX (US)

(72) Inventor: Joe Jordan, Willis, TX (US)

(73) Assignee: Advanced Frac Systems, LP, Houston, TX (US)

( * ) Notice: Subject to any disclaimer, the term of this patent is extended or adjusted under 35 U.S.C. 154(b) by 0 days.

(21) Appl. No.: 14/631,290

(22) Filed: Feb. 25, 2015

(65) Prior Publication Data

US 2016/0245044 A1 Aug. 25, 2016

(51) Int. Cl.

| | |
|---|---|
| ***E21B 41/00*** | (2006.01) |
| ***E21B 34/12*** | (2006.01) |
| ***E21B 34/14*** | (2006.01) |
| *E21B 34/00* | (2006.01) |

(52) U.S. Cl.
CPC ..... *E21B 34/14* (2013.01); *E21B 2034/007* (2013.01)

(58) Field of Classification Search
CPC .... E21B 41/00; E21B 34/12; E21B 2034/007; E21B 34/14
USPC ..... 166/259, 381, 386, 282, 284
See application file for complete search history.

(56) References Cited

U.S. PATENT DOCUMENTS

| | | | | |
|---|---|---|---|---|
| 3,007,523 | A * | 11/1961 | Vincent | E21B 33/12 166/281 |
| 4,292,988 | A * | 10/1981 | Montgomery | E21B 21/10 137/68.17 |
| 4,893,678 | A * | 1/1990 | Stokley | E21B 34/14 166/238 |
| 6,390,200 | B1 * | 5/2002 | Allamon | E21B 21/10 166/153 |
| 8,701,776 | B2 * | 4/2014 | Smith | E21B 21/103 166/318 |
| 2010/0282338 | A1 * | 11/2010 | Gerrard | E21B 33/1208 137/330 |

* cited by examiner

*Primary Examiner* — James G Sayre
(74) *Attorney, Agent, or Firm* — Jeffery E. Kubiak

(57) ABSTRACT

The finger or other protrusion allows downward movement of both fluid and balls, darts, or plugs through the tool or sliding sleeve until the ball, dart, or plug releases or actuates the gate. Once actuated the gate prevents further downward movement of any ball, dart, or plug past the gate while allowing fluid flow past both the gate and the ball, dart, or plug.

24 Claims, 9 Drawing Sheets

Prior Art

Prior Art

MECHANICAL METHOD FOR RESTORING DOWNHOLE CIRCULATION

BACKGROUND

In the recovery of downhole hydrocarbons, it is useful to inject fluids or fluid slurries through the wellbore and into the hydrocarbon bearing formation to facilitate or otherwise treat the wellbore or the hydrocarbon bearing formation. Typically, accessing a hydrocarbon bearing formation begins with drilling a wellbore through at least one hydrocarbon bearing zone. After the well is drilled, the well is completed by inserting a casing into the wellbore, cementing the casing into place, and accessing the hydrocarbon bearing formation through the casing after which fluids may be injected into or removed from the formation. In some cases the casing is not cemented into the wellbore, in such situations annular packers may be used for zone isolation.

In addition to holding the casing in place the cement acts as an annular seal between the casing and the hydrocarbon formation as well as a seal longitudinally along the length of the casing between various hydrocarbon formations or hydrocarbon formation zones. Annular packers may also be used as longitudinal seal along the length of the casing between various, formations or hydrocarbon formation zones. Annular seals, whether by cement or by packers, along the length of the casing prevents fracturing fluid that is pumped down the wellbore from migrating out of the targeted zone. If such a targeted zone is not isolated, the fracturing fluid that is pumped down the wellbore, will flow into the annular area between the casing and the formation and travel along the exterior of the casing out of the targeted zone into areas that are not hydrocarbon bearing formations and perhaps even into other separate hydrocarbon bearing formations quickly overcoming the ability of the casing to transport the fluid into the formations and the ability of the pumps to supply the fluid at pressure sufficient to fracture the formation. Similarly, annular fluid flow between the wellbore and casing may result in reduced recovery of fluids, loss of treatment fluids, or infiltration of undesired materials into a targeted or untargeted zones.

Usually after a zone has been isolated, ports in the casing may be opened to allow for the injection of fluids or slurries into the well. The open ports may also facilitate the removal of fluids or slurries from the hydrocarbon bearing formation. It may be desirable that the ports may be selectively opened or closed. Typically the ports are installed in the well in a closed condition by use of sliding sleeves. Usually sliding sleeve valves comprise a sleeve having circumferential seals such as O-rings at the top and bottom edges thereof to seal against a wall of the casing. Thus, when the sleeve is positioned over a port, the sleeve substantially prevents fluid communication between the interior of the casing and the hydrocarbon bearing formation through the port. The port may be opened by moving the sliding sleeve so that the sliding sleeve is located above or below the port or at least aligning a port in the sliding sleeve with the port in the casing thereby allowing fluid flow into or out of the desired zone. In many instances the sliding sleeve is equipped with a seat in the interior of the sliding sleeve.

More specifically, a tubular assembly is put together on the rig floor prior to being lowered into the well bore. If the operator does not plan to cement the tubular assembly into the wellbore, annular zonal isolation packers will also be installed along the length of the tubular assembly. Typically a packer will be installed both above and below each port and spaced far enough apart to straddle a particular hydrocarbon bearing formation or a portion of a particular zone of a hydrocarbon bearing formation. In many instances a single packer may serve as the upper packer on one zone as well as the lower packer on an adjacent zone. The tubular assembly is then lowered into the wellbore so that a port is adjacent to the desired zone.

In order to open the sliding sleeve, the seat is sized such that when a ball, dart, or plug is pumped into the well the ball will land on the seat sealing the interior of the tubular at the seat against fluid flow past the seat. As fluid pressure is increased the ball then exerts force against the seat and thus the sliding sleeve thereby causing the sliding sleeve to open providing fluid access from the interior of the tubular to the exterior of the tubular. Usually the sliding sleeve having a seat with the smallest diameter is placed towards the bottom for toe of the well. Sliding sleeves having seats with increasingly larger diameters are placed in the wellbore such that the smallest diameter is at the bottom of the well while the largest diameter is towards the top of the well. By having sliding sleeves with seats with larger diameters towards the top of the well, the smaller diameter balls are able to pass through the upper sliding sleeves without actuating the sliding sleeves as they pass through them. Unfortunately there are limitations that are imposed upon the operator when completing the well using progressively larger sized seats and balls in conjunction with sliding valves such as an increasingly reduced diameter of the wellbore towards the toe of the well which in turn leads to either reduced production or milling out each of the progressively smaller valve seats. Additionally there is a limitation on the number of zones that may be accessed when using progressively larger size seats and balls.

A recurring problem in some fracturing operations has been premature screen-out. In many cases premature screen-out occurs when the proppant or sand bridges in the wellbore or casing or at a point where the flow velocity slows allowing the proppant to settle out of the transport fluid thereby preventing further fluid flow past the flow restriction. This can happen when the zone in a hydrocarbon formation stops taking a sufficient flow or volume of fluid to allow continued fracking of the zone. When a screen out occurs the fluid pressure needed to keep injecting proppant into a well exceeds the limitations of the tubulars, wellhead, or surface equipment thereby shutting down the frac operation. Additionally with fluid circulation in the wellbore lost it becomes practically impossible to pump an additional ball into the wellbore to open any valve above the flow restriction in order to continue the frac operation.

In one current method of dealing with the screen out the operator may draw or flow the well back along with the ball seated on the valve seat that corresponds to the screen out. By drawing the well and the last ball sent downhole the operator is able to attempt to remove the flow restriction in order to continue dropping balls and fracking the other zones above. If the screened out zone will not take any additional fluid, then when the operator attempts to pump fluid downhole the ball will reseal on the ball seat thus preventing further pump down. In such an event the current solution is to bring in coil tubing to intervene in the well in order to reestablish circulation. This can be a costly and time consuming process.

SUMMARY

In an embodiment of the current invention a gate, including but not limited to fingers, a flapper, a rod, or a cam is locked open prior to the sleeve being actuated. When the gate is locked open any portion of the gate that might prevent passage of a ball, dart, or plug is prevented from blocking the passage of a ball, dart or plug. In practice the gate is part of a sliding sleeve assembly and the portion of the gate that might prevent passage of a ball, dart, or plug is locked in the open condition by the sliding sleeve.

The gate is actuated or put in an active closed position after a ball lands on the seat of the sliding sleeve and opens the sliding sleeve. As the sliding sleeve moves towards the bottom of the well in response to fluid pressure against the ball, the gate, now above the ball, is released so that fingers of the gate extend into the interior of the tubular or sliding sleeve. In the event that the formation or the sliding sleeve should prematurely screen out, thereby preventing fluid circulation, the operator will as before reverse the pumps on the surface in an attempt to flow the well back. The ball will flow back through the gate to a position above the gate. Once the ball is allowed to flow back some small amount the fingers on the gate prevent the ball from moving back down and reaching the ball seat and thus resealing the tubular. The fingers also allow fluid to flow around the ball thereby allowing the operator to re-establish circulation to the bottom of the well or at least to a lower zone in order to continue fracking operations and dropping additional balls.

DETAILED DESCRIPTION

The description that follows includes exemplary apparatus, methods, techniques, or instruction sequences that embody techniques of the inventive subject matter. However, it is understood that the described embodiments may be practiced without these specific details.

Figure 1:
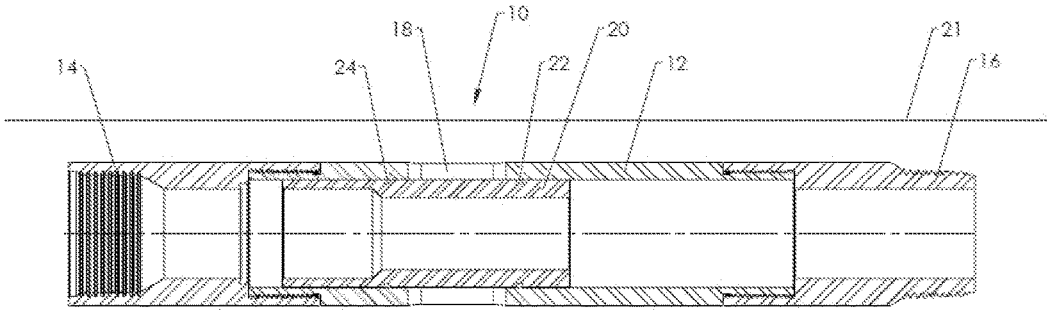
FIG. 1 is a cutaway view of a typical sliding sleeve.

FIG. 1 is a cutaway view of a typical sliding sleeve 10 having a housing 12 a box end 14 and a pen end 16. Typically the pen end 16 is towards the toe or bottom of the well while the box end 14 is towards the heel or upper end of the well. The housing 12 has at least one port 18. The port 18 is closed by the inner sleeve 20 the inner sleeve 20 has a first seal 22 and a second seal 24 that prevent any fluid flow around either the upper or lower end of the inner sleeve 20.

Typically sliding sleeve 10 is located in a wellbore 21 adjacent to a hydrocarbon bearing formation. The sliding sleeve 10 may be cemented in place or may have an annular packer both above and below the sliding sleeve 10 to direct the fluid flow into the hydrocarbon formation and to prevent the longitudinal movement of fluid either up or down the length of the casing.

Figure 2:
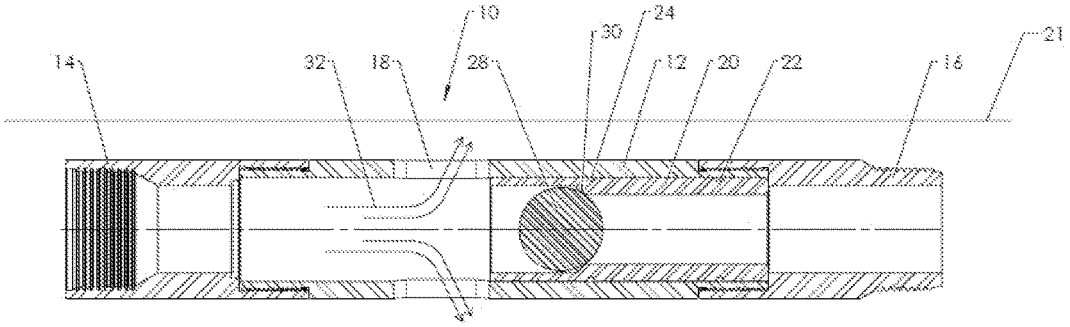
FIG. 2 depicts the sliding sleeve of FIG. 1 in the open condition.

FIG. 2 depicts the sliding sleeve of FIG. 1 in the open condition. Where a ball 28 has formed a seat 30 with the upper end of inner sleeve 22. Fluid pressure against the ball 28 from the surface has forced the inner sleeve 20 to move from its first or closed position to a second open position. With the inner sleeve 20 in the open position fluid flow as depicted by arrow 32 is able to flow from the interior of the sliding sleeve 10 to the exterior of sliding sleeve 10.

Figure 3:
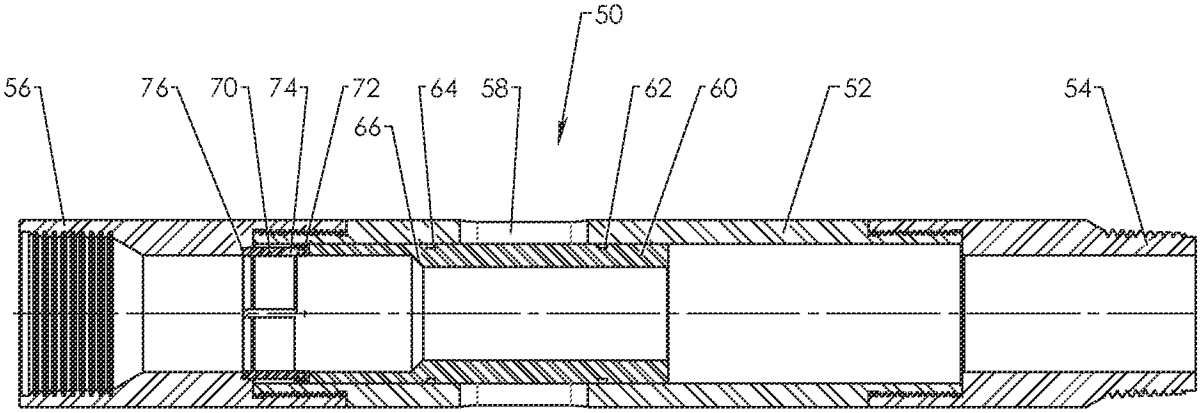
FIG. 3 depicts an embodiment of a sliding sleeve with the gate open.

FIG. 3 depicts an embodiment of the current invention where the sliding sleeve 50 has a housing 52, a pen end 54 a box end 56 and at least one port 58. The port 58 is provided with an inner sleeve 60 having a first seal 62 and a second seal 64. Together the inner sleeve 60, the first seal 62, and the second seal 64 prevent fluid flow through port 58. The inner sleeve 60 also has at least one shoulder 66. The shoulder 66 provides a seating surface for ball, dart, or plug to seat on and feel the interior of the sliding sleeve 50 against longitudinal fluid flow past sliding sleeve 50, through the interior of the tubular, and towards the bottom of the well. At the upper end of inner sleeve 60 is finger 70. Finger 70 is allowed to pivot on hinge 72 and is biased to move radially inward towards the interior of sliding sleeve 50 by biasing device 74. The biasing device 74 may be, but is not limited to, a spring, piston, elastomer, or other means to move the finger radially inwards. In some instances finger 70 may be biased or forced inward by a cam that forces the finger 70 to move inward in response to movement of inner sleeve 60. In the embodiment shown in FIG. 3 finger 70 is restrained in its inward position by lock 76 that engages finger 70 while inner sleeve 60 is in its first or closed position. In certain instances finger 70 may not be restrained in inward position but is not locked against downward movement until after the appropriate ball passes the finger 70 and actuates the one way gate. It is envisioned that in certain instances finger 70 may be made of a material that disappears within 30 days, or more preferably 15 days, of being placed downhole. Such erodible or dissolvable materials that disappear over time are for example polyglycolic acid, polylactic acid, or metals such as magnesium and aluminum.

Figure 4:
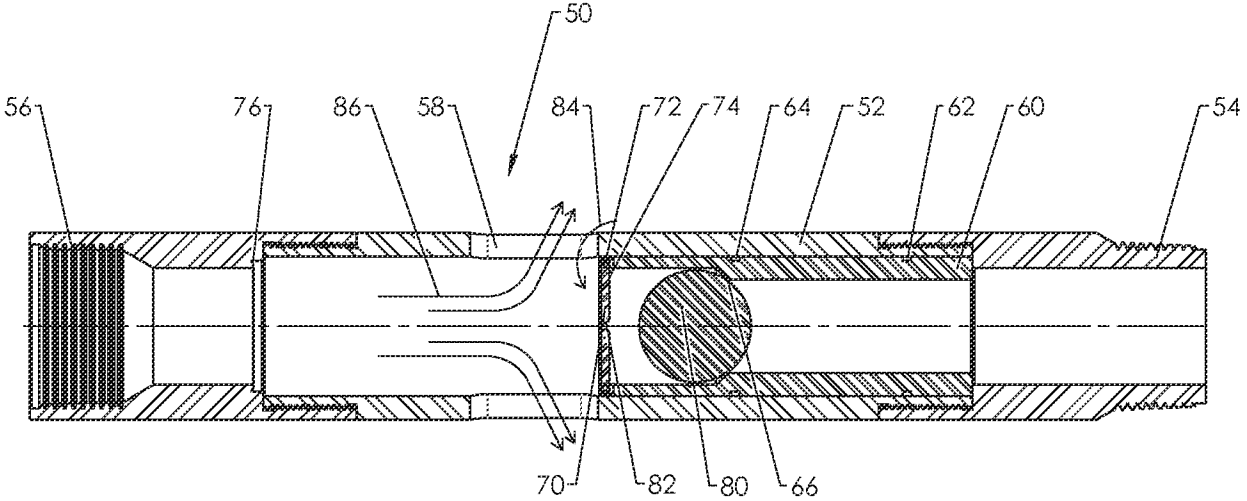
FIG. 4 depicts an embodiment of a sliding sleeve of FIG. 3 with the gate closed.

FIG. 4 depicts the embodiment of FIG. 3 in the open condition. Ball 80 has formed a seat on shoulder 66. Fluid pressure against the ball 80 from the surface has forced the inner sleeve 60 to move from its first or closed position to a second open position. With the inner sleeve 60 in its open position finger 70 is moved downward so that the upper end 82 of finger 70 disengages from lock 76 allowing finger 72 rotate radially inward in the direction of arrow 84. With the inner sleeve 60 in the open position fluid flow as depicted by arrow 86 is able to flow from the interior of sliding sleeve 50 to the exterior siding sleeve 50.

Figure 5:
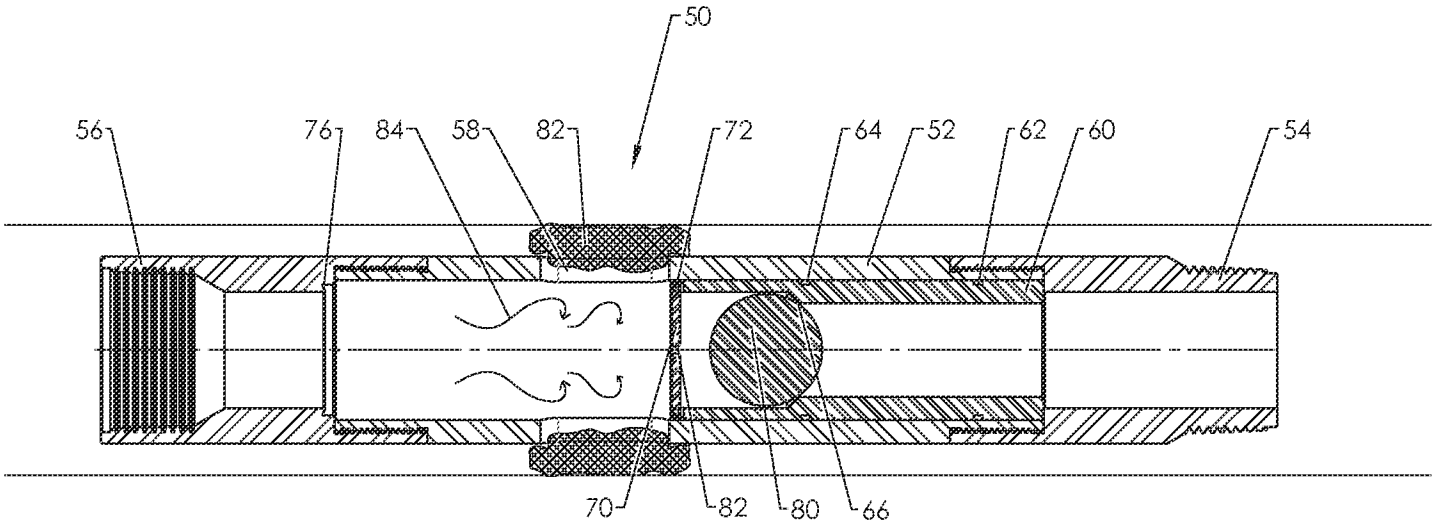
FIG. 5 depicts an embodiment of the sliding sleeve of FIG. 4 with the gate closed and the sliding sleeve port screened out.

FIG. 5 depicts the sliding sleeve 50 where the inner sleeve 60 has been shifted down towards the toe of the well by ball 80 and finger 70 has rotated radially inward. In FIG. 5 however sand 82 has built up or bridged across the exterior of port 58. The sand 82 now blocks fluid flow from the interior of the sliding sleeve 50 to the exterior of the sliding sleeve 50 so that fluid as depicted by arrows 84 is no longer able to flow through port 58.

Figure 6:
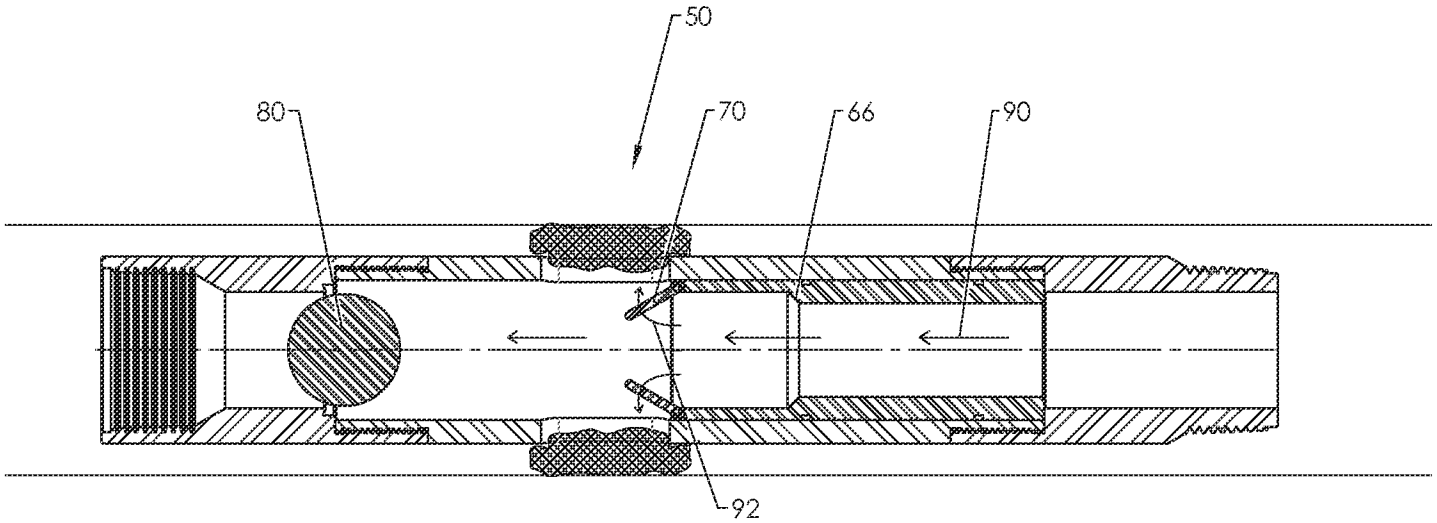
FIG. 6 depicts an embodiment of the sliding sleeve of FIG. 5 as the operator draws the well back.

FIG. 6 depicts sliding sleeve 50 as the operator tries to draw back the well to reestablish circulation in the well.

With the pumps reversed fluid flows from the lower portion of the well towards the surface as indicated by arrows 90. As the fluid flows towards the surface ball 80 is dislodged from shoulder 66 and moves some distance towards the surface. The ball however must be moved at least a sufficient distance towards the surface to pass finger 70 of the gate. As the ball 80 passes the finger 70, the force applied by the bias device 74 is overcome by the force the ball exerts against finger 70 causing finger 72 rotate radially outward in the direction of arrow 92 allowing the ball 80 to pass finger 70. Once ball 80 passes finger 70 biased device 74 again causes finger 72 rotate radially inward. Depending upon the amount of fluid drawn back as well as other wellbore parameters such as fluid flow out of a previously treated zone balls that reside on seats below the screened out sliding sleeve 50 may also be moved upward off their seat and past each gate that may actuated with a finger moving radially inward.

Figure 7:
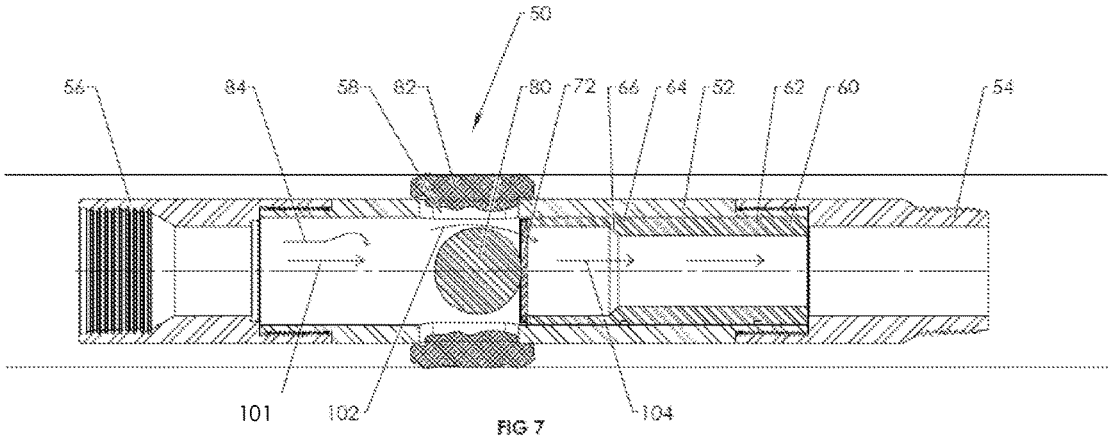
FIG. 7 depicts an embodiment of the sliding sleeve of FIG. 6 with a ball prevented from moving downward by the closed gate while fluid flows around the ball.

FIG. 7 depicts sliding sleeve 50 after the operator has reestablished circulation in the well with the surface pumps pumping fluid down the well bore as indicated by arrow 101. The sand 82 continues to block port 58 so that is fluid flows towards 58 the fluid flow is diverted back towards the interior of the sliding sleeve 50 as indicated by arrow 84. However as ball 80 is pushed down the interior of sliding sleeve 50 it encounters finger 72 and is prevented from traveling further down the well bore and landing on shoulder 66. With ball 80 held on finger 72 fluid flow is allowed to pass around ball 80 as indicated by arrow 102 and continue further down the well as indicated by arrow 104. With fluid flow reestablished the operator may then drop the next ball into the well bore to actuate a tool or sliding sleeve above sliding sleeve 50.

Figure 9:
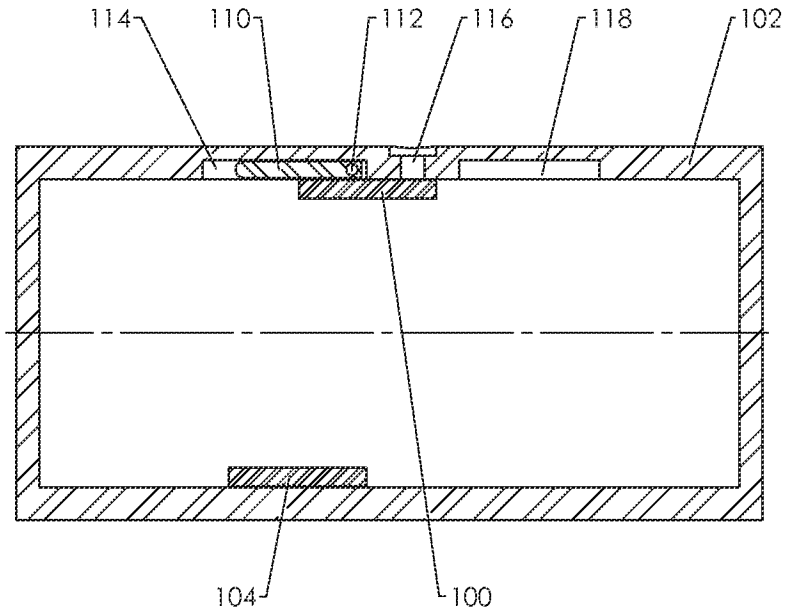
FIG. 9 is a side view of the actuating mechanism prior to actuation.
Figure 8:
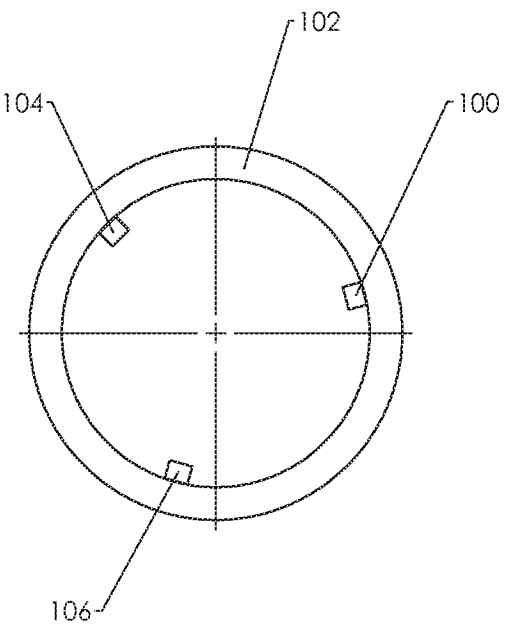
FIG. 8 depicts an alternative embodiment of a gate mechanism where the actuating mechanism occupies only a portion of the inner circumference of a tubular.

FIG. 8 depicts an alternative embodiment of a gate mechanism where the actuating mechanism 100 occupies only a portion of the inner circumference of tubular 102. Actuating mechanism 100 is sized such that a ball (not shown) that will actuate the next sleeve below the gate will also actuate the gate. In some instances it may be necessary to add protrusions such as protrusion 104 and 106 to the interior of tubular 102. The protrusions 104 106 allow the ball to interact with actuating mechanism 100 and when the gate mechanism is actuated allow fluid flow to pass by the ball when it is held at the gate FIG. 9 is a side view of actuating mechanism 100 prior to actuation. Finger 110 is recessed into the side wall of tubular 102 in side pocket 114 and is biased radially outward by biasing device 112. In this instance the biasing device 112 is a spring. The actuating mechanism 100 is held in place so that at least a portion of actuating mechanism 100 is adjacent to finger 110 and holds finger 110 in side pocket 114. The actuating mechanism 100 in this instance is prevented from longitudinally moving by shear screw 116.

Figure 10:
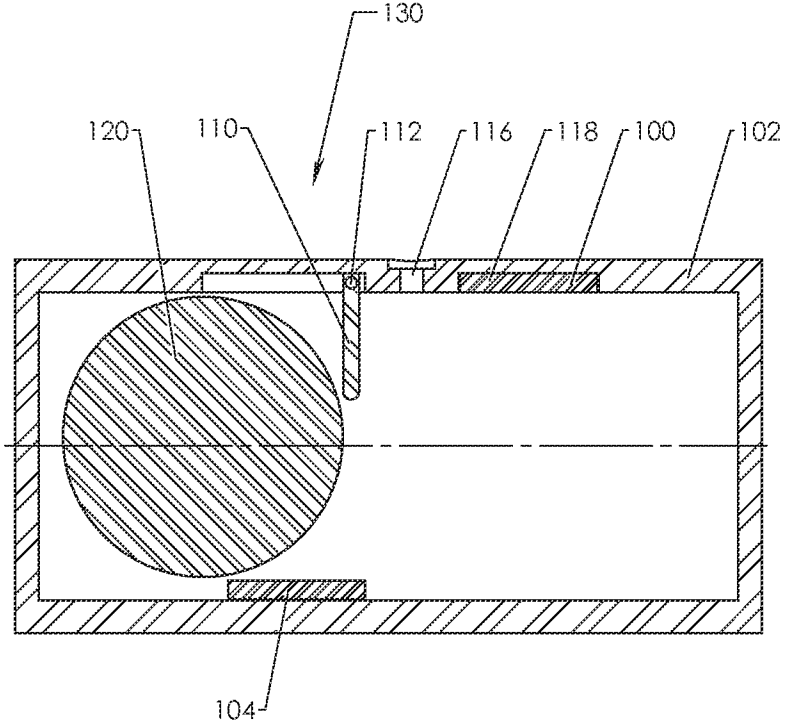
FIG. 10 is a side view of actuating mechanism after actuation where the well has screened out and the actuating ball is flowed back some distance above the gate.

FIG. 10 is a side view of actuating mechanism 100 after actuation and after the well has screened out the operator has been able to flow back the actuating ball 120 some distance above the gate 130. In order to actuate the actuating mechanism 100 actuating ball 120 was forced toward actuating mechanism 100 by protrusion 104 and 106. Longitudinal force was then exerted by actuating ball 120 upon actuating mechanism 100 and through actuating mechanism 100 upon shear screw 116 shearing shear screw 116 and allowing actuating mechanism 100 to move longitudinally downward. While shear screw 116 is described as a shear screw it may be a shear pin or any other mechanism known in the art that will retain actuating mechanism 100 in place until a predetermined force acts upon shear screw 116. After actuation the actuating mechanism 100 moves longitudinally downward into recess 118 where the actuating mechanism 100 is allowed to move radially outward into recess 118 thereby allowing the ball 120 to pass. Also as actuating mechanism 100 moves longitudinally downward finger 110 is released and is free to move. Biasing device 112 forces the finger 110 to move radially inward towards the interior of tubular 102 after which finger 110 will allow the ball 120 to move upwards in the well but will no longer allow the ball 120 to downward past gate 130.

While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A downhole device comprising:

a housing, a sleeve having at least a first position and a second position, a finger having at least a first position and a second position, a lock, wherein the lock prevents the finger from moving inwards until the sleeve moves towards the sleeve's second position, and a biasing device, wherein the biasing device applies a force to move the finger from its first position towards the finger's second position, a ball, wherein, the finger in the second position allows the ball to move upwards past the finger, wherein, after the ball is allowed to move upwards past the finger the ball is permanently prevented from moving downwards past the finger.

2. The downhole device of claim 1 wherein, the ball moves the sleeve.

3. The downhole device of claim 1 wherein, a fluid flow is allowed past the ball and the finger.

4. The downhole device of claim 1 wherein, the finger disappears within a predetermined period.

5. The downhole device of claim 1 wherein, the finger is polyglycolic acid.

6. The downhole device of claim 1 wherein, the finger is magnesium.

7. The downhole device of claim 1 wherein, the finger is aluminum.

8. The downhole device of claim 1 wherein, the finger is elastomeric and the bias device is incorporated into the finger.

9. The downhole device of claim 1 wherein, the lock is attached to the housing.

10. The downhole device of claim 1 wherein, the lock is attached to the sleeve.

11. A downhole device comprising:

a housing, a ball, a sleeve, a finger having at least a first position and a second position, a lock, wherein the lock prevents the finger from moving inwards until the ball moves the sleeve past the finger, and a biasing device, wherein the biasing device applies a force to move the finger from its first position towards the finger's second position in response to the balls passage, wherein, the finger in the second position allows the ball to move upwards past the finger, further wherein, after the ball is allowed to move upwards past the finger the ball is permanently prevented from moving downward past the finger.

12. The downhole device of claim 11 wherein, a fluid flow is allowed past the ball and the finger.

13. The downhole device of claim 11 wherein, the finger disappears within a predetermined period.

14. The downhole device of claim 11 wherein, the finger is polyglycolic acid.

15. The downhole device of claim 11 wherein, the finger is magnesium.

16. The downhole device of claim 11 wherein, the finger is aluminum.

17. The downhole device of claim 11 wherein, the finger is elastomeric and the bias device is incorporated into the finger.

18. The method of actuating a one-way lock comprising:

preventing a finger from moving inwards until a ball moves downwards past the finger, dropping the ball, unlocking a finger in response to passage of the ball, moving the finger radially inwards, allowing the ball to move upwards past the finger, and permanently preventing the ball from moving downwards past the finger in response to downward fluid flow.

19. The method of claim 18 wherein, a biasing device applies a force to move the finger inwards in response to the balls passage.

20. The method of claim 18 wherein, the finger disappears within a predetermined period.

21. The method of claim 18 wherein, the finger is polyglycolic acid.

22. The method of claim 18 wherein, the finger is magnesium.

23. The downhole device of claim 18 wherein, the finger is aluminum.

24. The method of claim 18 wherein, the finger is elastomeric and the bias device is incorporated into the finger.

* * * * *